United States Patent [19]

Finkel

[11] 4,441,642

[45] Apr. 10, 1984

[54] CORE HOLDER AND DISPENSER

[75] Inventor: Henry Finkel, Westmount, Canada

[73] Assignee: Stanbel Ltd., Montreal, Canada

[21] Appl. No.: 390,354

[22] Filed: Jun. 21, 1982

Related U.S. Application Data

[63] Continuation-in-part of Ser. No. 282,274, Jul. 10, 1981.

[30] Foreign Application Priority Data

Aug. 11, 1981 [CA] Canada ..... 383632

[51] Int. Cl.[3] ..... B26D 1/02

[52] U.S. Cl. ..... 225/46; 225/48; 225/66; 225/77; 225/85; 225/90

[58] Field of Search ..... 225/34, 35, 61–64, 225/66, 77, 80, 84, 85, 82, 90, 42, 48–50, 46, 47; 206/395, 396; 242/48, 138, 129.8, 125.3; 229/17 R, 17 S, 22, 143 A, 51 TS

[56] References Cited

U.S. PATENT DOCUMENTS

| | | | |
|---|---|---|---|
| 233,131 | 10/1880 | Auchincloss | 225/34 X |
| 1,784,258 | 12/1930 | Tynan | 225/77 X |
| 1,897,143 | 2/1933 | Powell | 206/395 |
| 2,496,945 | 2/1950 | Johnson | 225/63 X |
| 2,499,130 | 2/1950 | Chase | 242/138 X |
| 2,550,944 | 5/1951 | Stack | 225/85 X |
| 2,806,660 | 9/1957 | Marcoff-Moghadam | 225/61 X |
| 2,819,851 | 1/1958 | Robertson | 225/77 X |
| 2,973,126 | 2/1961 | Kresslein | 225/63 |
| 3,231,162 | 1/1966 | Michel | 225/77 X |
| 3,338,399 | 8/1967 | Burt | 206/395 |
| 3,593,846 | 7/1971 | Dolas | 229/22 X |

FOREIGN PATENT DOCUMENTS

| | | |
|---|---|---|
| 382521 | 7/1938 | Canada . |
| 677672 | 1/1964 | Canada . |
| 904220 | 7/1972 | Canada . |

*Primary Examiner*—Frank T. Yost

*Attorney, Agent, or Firm*—Fleit, Jacobson, Cohn & Price

[57] ABSTRACT

The disclosure teaches a dispensing package for elongated strands, such as cord, thread, yarn or the like, wound on a spool. The package is made of a rigid but flexible material, and preferably, an oleofin plastic material. The package includes a floor member and a parallel ceiling member spaced from the floor member by a wall structure. The wall structure includes a two-walled arrangement consisting of two walls at an angle to each other and connected to each other at a common edge thereof. A third wall is opposite to the two-wall arrangement and consists of tab members extending from both the floor and ceiling members. Attachment means are included on the tab so that the third wall can be either fastened or unfastened. An opening in the two-walled arrangement includes a blade holder which extends into the opening. Side notches in the side edges of the two-walled arrangement comprise retaining means for retaining the free end of the strands.

26 Claims, 17 Drawing Figures

CORE HOLDER AND DISPENSER

CROSS-REFERENCE TO RELATED APPLICATION

This is a continuation in part application of parent application Ser. No. 282,274, filed July 10, 1981.

BACKGROUND OF INVENTION (a) Field of the Invention

The invention relates to a dispensing package for elongated strands, such as cord, thread or yarn, wound on a spool. The invention also relates to a blank for such a dispensing package.

(b) Description of Prior Art

It is known in the prior art to provide such dispensing packages as shown, for example, in Canadian Pat. No. 116,272, Greene et al, issued Jan. 26, 1909; Canadian Pat. No. 271,115, McDougall, issued May 31, 1972; Canadian Pat. No. 601,354, Ruiz, issued July 12, 1960; Canadian Pat. No. 626,871, Zackheim, issued Sept. 5, 1961; U.S. Pat. No. 2,042,311, Kirsch, issued May 26, 1936; and U.S. Pat. No. 3,284,025, issued Nov. 8, 1966.

SUMMARY OF INVENTION

The present invention relates to a dispensing package which is unique in design and construction, and to a blank for such a dispensing package.

In accordance with an embodiment of the invention there is provided a blank for a dispensing package for elongated strands, such as cord, thread, yarn, or the like, wound on a spool, said blank being made of a rigid but flexible material and comprising: a main body portion having a first end and a second end; a fold line extending longitudinally of said main body portion from said first end to said second end; a first outside flap member and a first inside flap member foldingly connected at the first end of said main body portion; a second outside flap member and a second inside flap member foldingly connected at the second end of said main body portion; an elongated tab member connected to a free end of one of said outside flap members; and a short tab member connected to a like free end of the other one of said flap members.

In accordance with a further embodiment of the invention there is provided a dispensing package for elongated strands, such as cord, thread, yarn, or the like, wound on a spool, which comprises: a rigid but flexible material; a floor member and a parallel ceiling member spaced from said floor member by wall means; said wall means comprising: (a) a two-walled arrangement consisting of two walls at an angle to each other and connected to each other at a common edge thereof; and (b) a third wall opposite to said two-walled arrangement; an opening in said two-walled arrangement; and blade holder means extending in said opening.

BRIEF DESCRIPTION OF DRAWINGS

The invention will be better understood by an examination of the following description together with the accompanying drawings in which.

DESCRIPTION OF PREFERRED EMBODIMENTS

Figure 1:
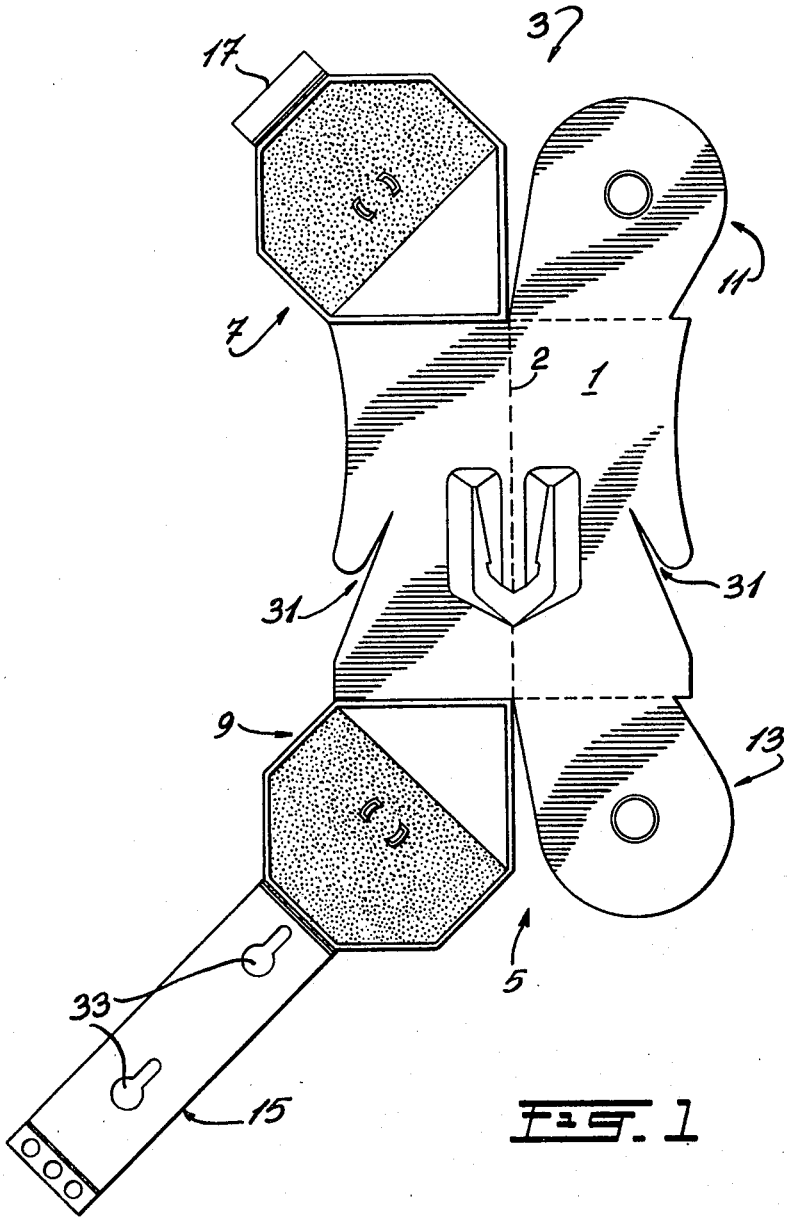
FIG. 1 is a view of the outside surface of the blank.
Figures 2, 3:
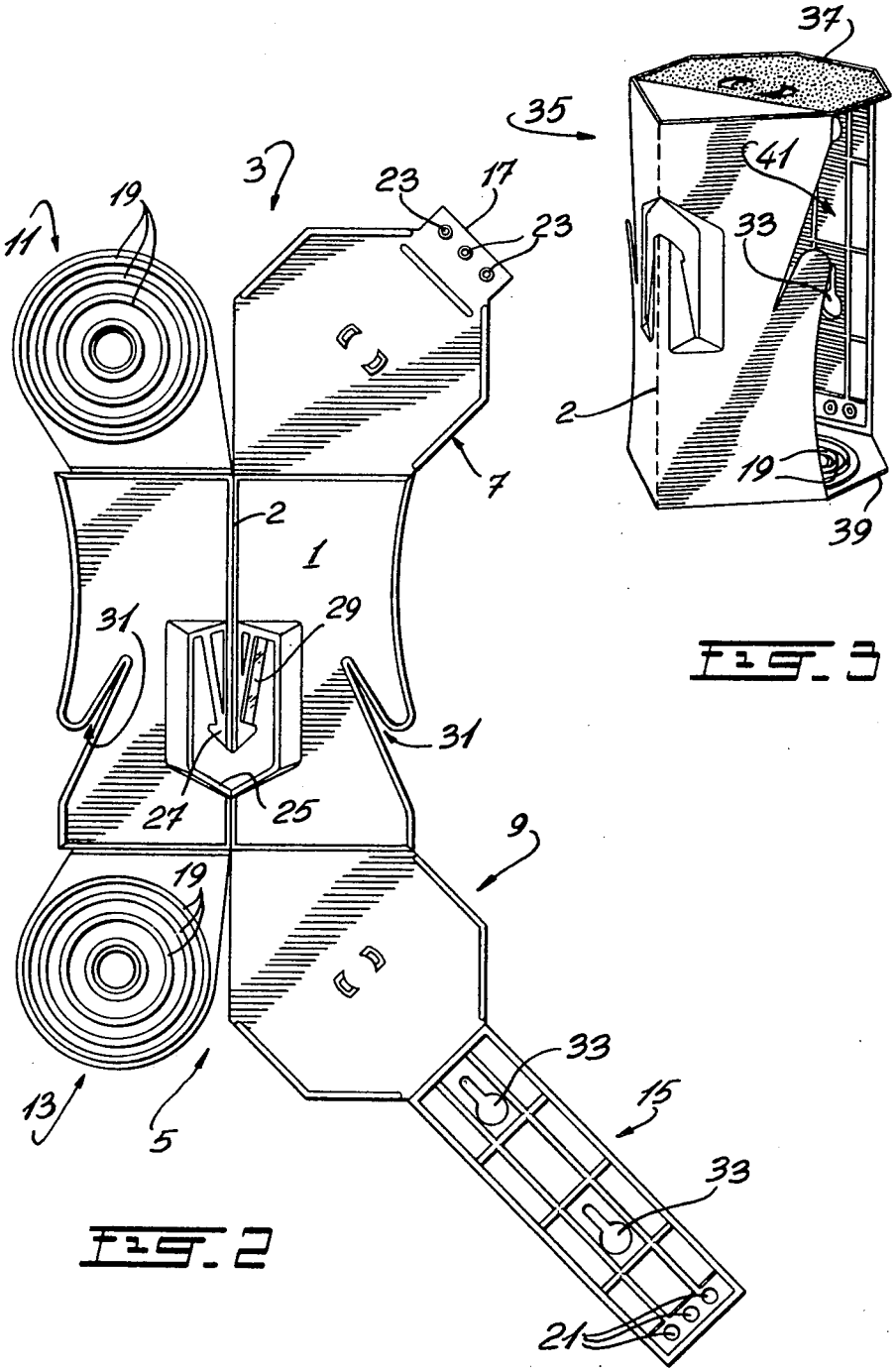
FIG. 2 is a view of the inside surface of the blank.
FIG. 3 is a perspective view of the dispensing package in accordance with the invention.

Referring now to FIGS. 1 and 2, the blank includes a main body portion 1 having a fold line 2 extending longitudinally of the main body portion. The main body portion also has a first end 3 and a second end 5. Foldably connected at the first end is an outside flap member 7 and foldably connected to the second end 5 is an outside flap member 9. Also foldably connected to the first end 3 is an inside flap member 11, and foldably connected to the end 5 is an inside flap member 13. Extending from a free end of the flap member 9 is an elongated tab 15, and extending from a like free end of the flap member 7 is a short tab 17.

As can be seen, the free ends of 11 and 13 are somewhat semi-circular in shape, and, referring to FIG. 2, a series of concentric protrusions 19 are disposed on the inner surface of the flaps 11 and 13. The flaps 7 and 9 are seven-sided figures, and the tab 15 extends from a free side of the tab 9 which free side is away from the side foldably connected to the main body portion 1 and extending away from the main body portion. As abovementioned, the tab 17 is connected to a like side of the flap 7.

Referring again to FIG. 2, the inner surface of the tab 15 includes fastening means 21 for engaging with fastening means 23 on the tab 17. In one embodiment of the invention, the fastening means comprise snaps.

Disposed centrally of the main body portion is an opening 25, and a blade holder 27, including a blade 29, extends in the opening 25. Disposed at both side edges of the main body portion are retaining means 31 for retaining the free end of the thread. In the illustrated embodiment, the retaining means are notches in the side edges.

Tab means 15 include openings 33 disposed on the longitudinal center line of the tab means.

In order to assemble a package from the blank, the main body portion is first folded along the fold line 2. The flaps 11 and 13 are then folded so that they extend inwardly and at right angles to the main body portion 1, and the flaps 7 and 9 are then folded in a like manner to overlie the flaps 11 and 13 respectively. The tabs 15 and 17 are then folded to extend at right angles to their respective flap members to form a wall parallel to the wall formed by the main body portion 1 and opposite thereto. The structure will then have the shape as illustrated in FIG. 3.

As can be seen in FIG. 3, the main body portion forms a two-walled arrangement 35, the two walls being at an angle to each other and connected to each other at a common edge thereof. The common edge is, of course, the fold line 2.

The tabs 15 and 17 form third wall means, comprising, in this embodiment, a third wall 41 which is parallel to the two-walled arrangement and opposed thereto.

The flaps form a ceiling 37 and a floor 39 respectively. Disposed on the inner surface of both the ceiling and floor are the concentric circular protrusions 19. The protrusions permit the acceptance of different size spools into the dispensing package.

The openings 33 in the third wall 41 permit the package to be hung on the wall on nails or screws.

In operation, a spool is placed into the dispensing package by first unfastening the fastening means on the one end of the tabs or inserted prior to full assembly of the dispensing package. The spool will then be supported in both of the protrusions top and bottom for rotatable motion about the center of the concentric circles.

A free end of the elongated strand is then pulled out around the outside of the two-walled arrangement and, when a desired length of strand has been withdrawn, it is cut-off using the blade 29 in the opening 25. The face end of the thread can then be retained in either one of the notches 31 on the side edges of the main body portion.

The embodiment illustrated in FIGS. 1 to 3 will accommodate a role of twine or the like which has a side feed. That is, the free end of the twine comes off the outside of the roll.

There are rolls of twine whose free end comes out through the center of the roll. The embodiments illustrated in FIGS. 1 to 3 could not very easily accommodate such a center feed roll.

It is therefore an object to modify the previously illustrated embodiment to be adaptable to accommodating a center feed roll.

In order to modify the package to be adaptable to accommodating a center feed roll, an opening is provided in either the floor member or the parallel ceiling member.

Figure 4:
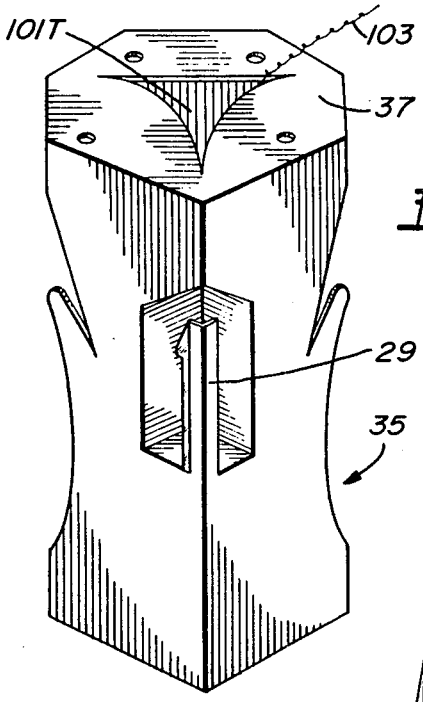
FIG. 4 is a perspective view of the dispensing package with the opening in the ceiling member.

Referring to FIG. 4, the dispensing package 35, also made of a rigid but flexible (preferably plastic) material, has an opening 101T in the ceiling member 37. As can be seen, the free end of the twine 103 emerges from this central opening and can be lodged in the notches 31 for retention as described with respect to FIGS. 1 to 3, or brought to the blade 29 for cutting as also above-described. It will, of course, be appreciated that the opening 37 could be located in the floor member 39.

Figure 5:
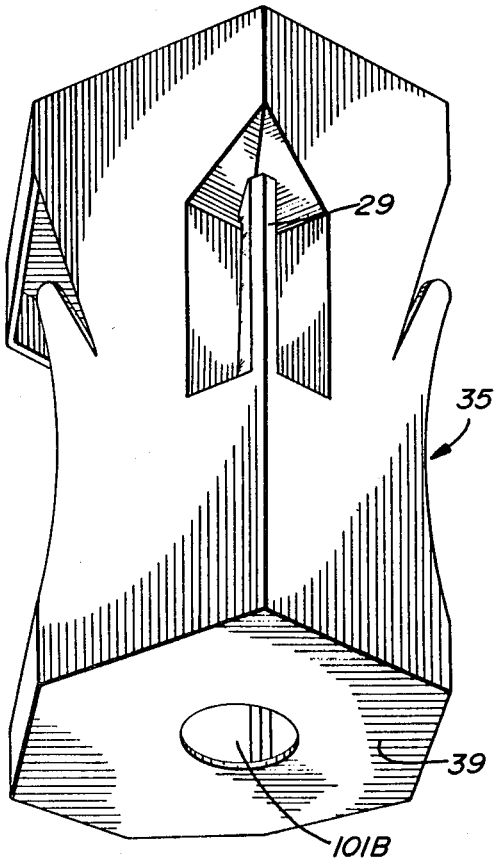
FIG. 5 is a perspective view of the dispensing package with the opening in the floor member.
Figure 6A:
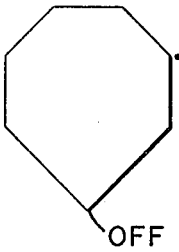
FIGS. 6A to 6L show different shapes for the floor and ceiling members of the dispensing packages.
Figure 6B:
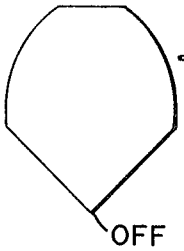
Figure 6C:
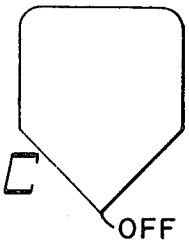
Figure 6D:
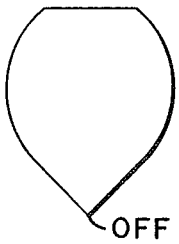
Figure 6E:
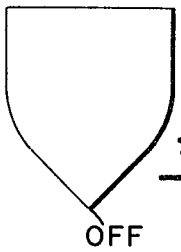
Figure 6F:
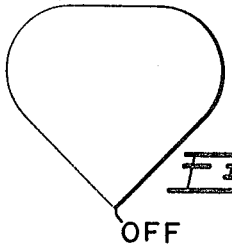
Figure 6G:
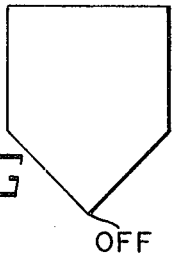
Figure 6H:
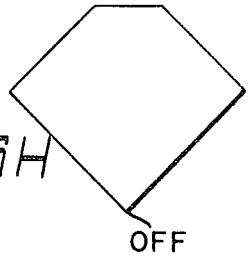
Figure 6I:
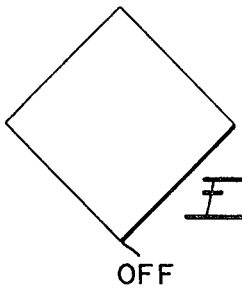
Figure 6J:
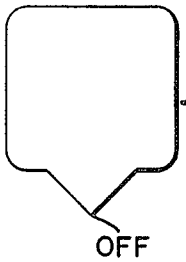
Figure 6K:
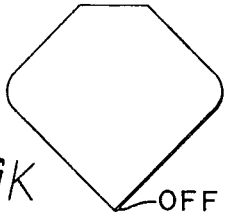
Figure 6L:
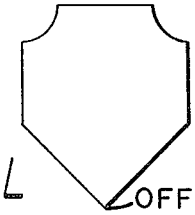

FIG. 5 illustrates a dispensing package which can also be used with a center feed roll of twine but wherein the opening for the twine 101B is in the floor member 39.

Although specific shapes have been above-illustrated, it will of course be appreciated by one skilled in the art that the dispensing package can take different shapes. Thus, a top view of the dispensing package could be either pear-shaped or, in fact, the entire dispensing package could be cylindrical. A variety of different shapes for the floor and ceiling members are illustrated in FIGS. 6A to 6L. As can be seen, each of the shapes includes an offset OFF as between the blade 29 and the outer periphery of the roll of twine which is inserted in the dispensing package. (In FIG. 6I, any one of the corners could be the offset corner). This is to ensure that the outer periphery of the roll does not interfere with the operation of the blade.

Thus, a cylindrical package would be useful only when the diameter of the roll is smaller than the diameter of the dispensing package. In the case where the diameter of the roll is substantially equal to the diameter of the dispensing package, then a protruding member would have to be provided for the blade so that the blade holder and blade would protrude outwardly from the outer periphery of the dispensing package.

It is also pointed out that the above embodiments illustrated a dispensing package which could be mounted with screws onto a wall. Obviously, it may be unnecessary to have such a mounting means on the dispensing package. Thus, a square-shaped top view for the dispensing package is also possible.

Although in FIG. 2 ridges 19 were shown on members 11 and 13, it would of course be possible to have ridges on only one of the members or, indeed, it would be possible to make the dispenser without any ridges at all without defeating the working of the dispenser in accordance with the invention. The ridges are shown as a preferred embodiment and a preferred feature of the invention.

The dispensing package is made of a flexible but rigid material. Preferably, the package is made of a plastic material.

Although specific embodiments have been above-described, this was for the purpose of illustrating, but not limiting, the invention. Various modifications, which will come readily to the mind of one skilled in the art, are within the scope of the invention as defined in the appended claims.

I claim:

1. A blank for a dispensing package for elongated strands, such as cord, thread, yarn, or the like, wound on a spool, said blank being made of a rigid but flexible material and comprising:

a main body portion having a first end and a second end;

a fold line extending longitudinally of said main body portion from said first end to said second end;

a first outside flap member and a first inside flap member foldingly connected at the first end of said main body portion;

a second outside flap member and a second inside flap member foldingly connected at the second end of said main body portion;

an elongated tab member connected to a free end of one of said outside flap members; and a short tab member connected to a like free end of the other one of said flap members;

and further including an opening disposed somewhat centrally in said main body portion; and a blade holder means extending in said opening in the longitudinal direction of said main body portion.

2. A blank as defined in claim 1 and further comprising notches in at least one side edge of said main body portion.

3. A blank as defined in claim 2 wherein said outside flap members are seven-sided, said flap members being foldingly connected to said main body portion at one side thereof;

said tab members being connected to a second side of each of said flap members, said second side being at an angle to said one side and facing away from the said one side and from the main body portion.

4. A blank as defined in claim 3 wherein said inside flaps have semi-circular free ends with a center.

5. A blank as defined in claim 4 wherein said inside flaps have an inner surface and an outer surface;

a series of circular protrusions concentric on said center of being disposed on the inner surface of each of said inside flaps.

6. A blank as defined in claim 5 and further including openings along the longitudinal center line of said elongated tab.

7. A blank as defined in claim 6 comprising fastening means at the free ends of said tabs whereby to fasten said elongated tab to said short tab.

8. A blank as defined in claim 7 wherein said fastening means comprises snap means.

9. A blank as defined in any one of claims 1, 2 or 5 wherein said rigid but flexible material comprises an olefin plastic material.

10. A dispensing package for elongated strands, such as cord, thread, yarn, or the like, wound on a spool;
said package comprising:
a rigid but flexible material;
a floor member and a parallel ceiling member spaced from said floor member by wall means;
said wall means comprising:
(a) a two-walled arrangement consisting of two walls at an angle to each other and joined to each other at a common edge thereof; and
(b) a third wall opposite to said two-walled arrangement;
an opening in said two-walled arrangement; and
blade holder means extending in said opening.

11. A package as defined in claim 10 and further comprising retaining means in the side edges of said two-walled arrangement.

12. A package as defined in claim 11 wherein said retaining means comprises notches in the side edges of said two-walled arrangement.

13. A package as defined in claim 12 wherein said third wall comprises an elongated tab extending from one of said ceiling or said floor members and a short tab extending from the other one of said ceiling or floor members; and
fastening means at the free ends of said tab members whereby to fasten said elongated tab to said short tab.

14. A package as defined in claim 13 wherein each of said ceiling means and said floor means has an inner surface;
a series of circular protrusions extending inwardly from the inner surface of said ceiling member and said floor member.

15. A package as defined in claim 14 and further including openings extending longitudinally along the center line of said third wall.

16. A package as defined in claim 15 wherein said material is an oleofin plastic material.

17. A package as defined in claim 10 wherein said opening is located in the common edge area of said wall means.

18. A dispensing package for elongated strands, such as cord, thread, yarn or the like, wound on a spool;
said package comprising:
a rigid but flexible material;
a floor member and a parallel ceiling member spaced from said floor member by wall means;
said wall means comprising at least two walls at an angle to each other and joined to each other at a common edge thereof;
an opening in said wall means;
said opening being located in the common edge area of said wall means; and
blade holder means extending in said opening.

19. A package as defined in any one of claims 10 or 18 and further including an opening in said ceiling member;
whereby twine may be extracted through said opening in said ceiling member.

20. A package as defined in any one of claims 10 or 18 and further including an opening in said floor member;
whereby twine may be extracted through said opening in said floor member.

21. A package as defined in claim 18 and further comprising retaining means in the side edges of said wall means.

22. A package as defined in claim 21 wherein said retaining means comprises notches in the side edges of said wall means.

23. A package as defined in claim 22 wherein each of said ceiling means and said floor means has an inner surface;
a series of circular protrusions extending inwardly from the inner surface of said ceiling member and said floor member.

24. A package as defined in claim 23 wherein said material is an oleofin plastic material.

25. A package as defined in any one of claims 16 or 24 and further including an opening in said ceiling member;
whereby twine may be extracted through said opening in said ceiling member.

26. A package as defined in any one of claims 16 or 24 and further including an opening in said floor member;
whereby twine may be extracted through said opening in said floor member.

* * * * *

UNITED STATES PATENT AND TRADEMARK OFFICE

CERTIFICATE OF CORRECTION

PATENT NO. : 4,441,642

DATED : April 10, 1984

INVENTOR(S) : Henry Finkel

It is certified that error appears in the above-identified patent and that said Letters Patent is hereby corrected as shown below:

In the title page,

Change: "[54] CORE" To: -- [54] CORD --

Signed and Sealed this

*Fifth* Day of *March 1985*

[SEAL]

*Attest:*

DONALD J. QUIGG

*Attesting Officer* *Acting Commissioner of Patents and Trademarks*